United States Patent [19]

Gietzen

[11] 4,047,786

[45] Sept. 13, 1977

[54] ELECTRICAL CONNECTOR

[75] Inventor: James J. Gietzen, Smithtown, N.Y.

[73] Assignee: Dynamic Instrument Corporation, Hauppauge, N.Y.

[21] Appl. No.: 637,273

[22] Filed: Dec. 3, 1975

[51] Int. Cl.[2] ..... H01R 17/18

[52] U.S. Cl. ..... 339/154 A; 339/183

[58] Field of Search ..... 339/183, 154–157, 339/103, 104, 159, 166

[56] References Cited

U.S. PATENT DOCUMENTS

| | | | |
|---|---|---|---|
| 1,498,196 | 6/1924 | Pacent | 339/183 |
| 1,569,869 | 1/1926 | McIntosh | 339/183 |
| 2,255,336 | 9/1941 | Seghers | 339/159 R |
| 2,731,529 | 1/1956 | Leins | 339/158 |
| 3,721,939 | 3/1973 | Paugh | 339/103 R |

*Primary Examiner*—Roy Lake
*Assistant Examiner*—Neil Abrams
*Attorney, Agent, or Firm*—Eugene E. Geoffrey, Jr.

[57] ABSTRACT

An electrical connector for providing low voltage energy to portable electrical devices and includes a receptacle portion and a plug. The plug has means for engaging the receptacle portion and means for engaging the device to be energized.

3 Claims, 6 Drawing Figures

ELECTRICAL CONNECTOR

This invention relates to electrical connectors and more specifically to a novel and improved electrical connector for use in supplying low voltages to devices such as portable radios, calculators, camera equipment, and the like.

Many portable devices such as those referred to above may either be battery operated or in the alternative operated from a power supply of the type plugged into a conventional wall outlet. Such supplies generally involve a transformer for reducing voltages of the order of 120 volts to lower voltages of the order of 2.5 to 10 volts which is rectified to provide direct current for operation of the devices. A variety of receptacles are provided on the portable equipment with the result that it is necessary to manufacture a wide range of plug-in power supplies, having different types of plugs for engagement of the receptacles on the portable devices being energized. This invention has as one of its objects a novel and improved connector involving a receptacle element attached to the cord leading from a power supply and a plug removable coupled to the receptacle for engagement with a receptacle in the device to be powered. With this arrangement and with plugs of different configurations, a single power supply can be adapted to energize devices having different types of receptacles.

Another object of the invention resides in the provision of a novel and improved electrical connector comprising a receptacle and plug for use with low voltage power supplies.

A still further object of the invention resides in the provision of a novel and improved connector embodying a receptacle for attachment to the low voltage cable extending from a power supply and an angle plug adapted to be coupled with the receptacle and having means for engaging the receptacle on the device to be energized.

The electrical connector in accordance with the invention comprises a receptacle attached to the end of a low voltage cable and having female connecting means. A plug has means extending from one surface thereof for engaging a receptacle on a device to be energized and means extending from another surface thereof for engaging the female connectors on the receptacle.

The above and other objects and advantages of the invention will become more apparent from the following description and accompanying drawings forming a part of this application.

Figure 1:
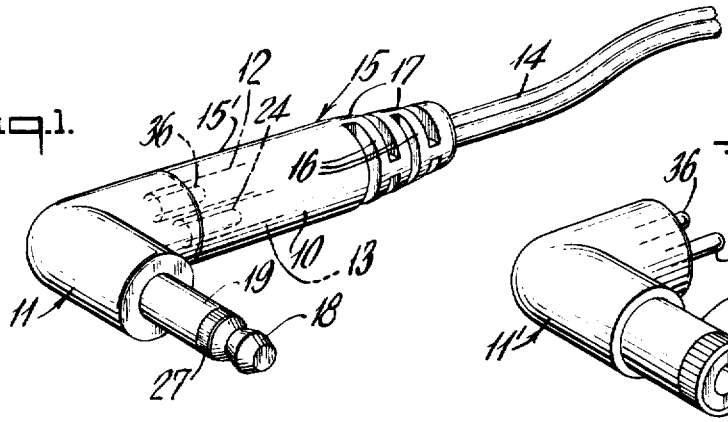
FIG. 1 is a perspective view of one form of a novel and improved electrical connector consisting of a plug and receptacle in accordance with the invention.
Figure 2:
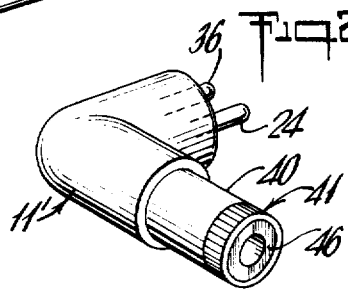
FIG. 2 is a perspective view of a modified form of plug for use with the receptacle shown in FIG. 1.
Figure 3:
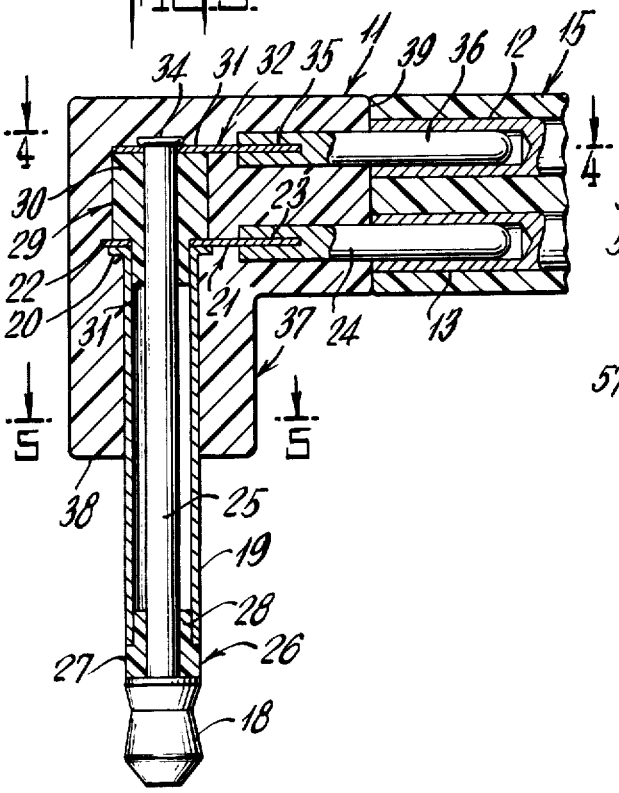
FIG. 3 is a fragmentary cross sectional view of the electrical connector shown in FIG. 1.
Figure 6:
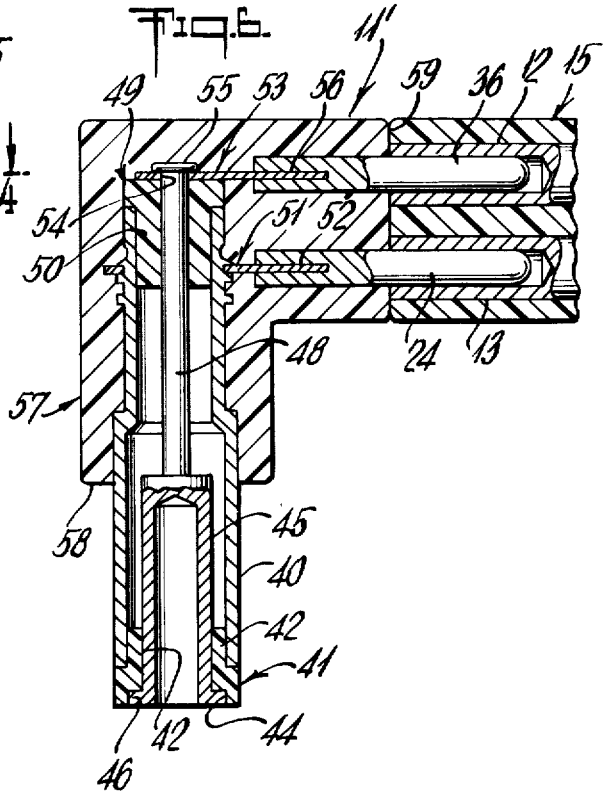
Figure 4:
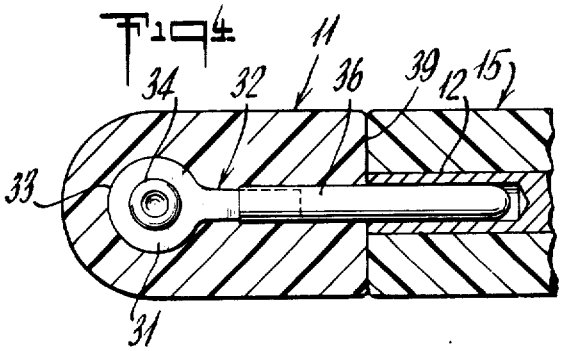
Figure 5:
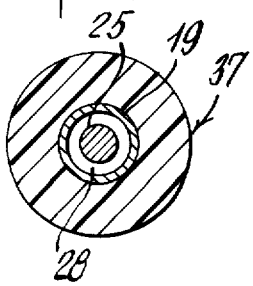

FIGS. 4 and 5 are cross sectional views of FIG. 3 taken along the lines 4—4 and 5—5 thereof; and FIG. 6 is a fragmentary cross sectional view similar to FIG. 3 and illustrates the plug of FIG. 2 in engagement with the receptacle shown in FIG. 1.

Referring now to the drawings, the electrical connector as illustrated in FIGS. 1, 3, 4 and 5 comprises a receptacle 10 and a plug 11. The receptacle 10 has a pair of female contacting means 12 and 13 which are connected to the cable 14. The contacting means 12 and 13 and a portion of the cable 14 are enclosed by a jacket 15 formed of an insulating material such as plastic and the like. The rear portion of the jacket is tapered and consists of a plurality of ring-like elements 16 coupled one to the others and to the body 15' of the jacket by webs 17 with successive webs being offet by 90° to provide a high degree of flexibility and thus prevent damage to the cable 14. The receptacle 10 is adapted to receive a plug such as the plug 11 shown in FIG. 1 or the plub 11' as shown in FIG. 2. While only two forms of plug are illustrated, it is evident that other forms of plugs may be used with equal effectiveness.

FIGS. 3, 4, and 5 illustrate in detail the structure of the plug 11 as shown in FIG. 1. This plug utilizes the tip and sleeve structure wherein the tip is denoted by the numeral 18 and the sleeve by the numeral 19. The sleeve 19 is provided with an outwardly extending flange 20 on the inner end thereof. A lug 21 has an annular end portion 22 electrically connected by welding, soldering or the like to the flange 20. The end portion 23 of lug 21 mechanically engages and is electrically coupled to a cylindrical pin 24.

The tip 18 is carried by a rod 25 which extends through an insulating member 26 having an enlarged portion 27 bearing against the tip 18 and having a diameter equal to the diameter of the sleeve 19. A portion 28 of the insluating member is of reduced diameter and fits into the end of the sleeve 19. This arrangement insulates the tip 18 and one end of the rod 25 from the sleeve 19. A second insulating member 29 has an enlarged portion 30 and a reduced portion 31. The reduced portion 31 extends within the sleeve 19 and the shoulder thereby produced seats against the lug 21. A second lug 32 has an annular portion 33 seated against the outer end of the insulating member 29 and has a central opening to receive the rod 25. The rod is swaged at 34 to secure the assembly in position. The end portion 35 of lug 32 mechanically engages and is electrically coupled to a cylindrical pin 36.

The structure described above is then enclosed within a housing 37 of insulating material which is molded about the structure with the tip 18 and a portion of the sleeve 19 extending from one surface 38 thereof and the pins 24 and 36 extending from another surface 39 thereof. The surfaces 38 and 39 are disposed at 90 degrees so that the structure forms in effect an annular connector. It is evident, however, that by modifying the structure of the lugs 21 and 32, the pins 24 and 36 could be disposed in parallel alignment with the sleeve 19.

A modified structure of the plug is shown in FIG. 6 wherein like numerals are used to denote corresponding components shown in FIGS. 3 and 6.

The structure shown in FIG. 6 embodies a cylindrical sleeve 40 having an insulator 41 on the outer end thereof. The insulator has a diameter equal to the diameter of the sleeve 40 and a reduced portion 42 adapted to seat within the sleeve 40. The insulator 41 is also provided with a central opening 43 and an annular recess 44 in the outer end thereof. An inner sleeve 45 extends through the opening 43 and has a flanged portion 46 seated within the recess 44. The inner end 47 of the sleeve 45 is closed and a rod 48 is secured thereto and extends through the sleeve 40. The inner end of the sleeve 40 carries an insulating member 49 having a portion 50 extending within the sleeve 40. A lug 51 surrounds the sleeve 40 and is electrically and mechanically secured thereto. A portion 52 of the lug 51 mechanically engages and is electrically coupled to a pin 24. A second lug 53 overlies the outer end of the insulator 49 and has an opening 54 to receive the rod 48. The rod 48 is swaged at 55 to secure the assembly in position. A portion 56 of the lug 53 is mechanically and electrically coupled to the pin 36. The assembly thus described is enclosed by a body of insulating material 57 molded about the structure so that a portion of the sleeve 40 extends from one surface 58 thereof and the pins 24 and 36 extend from another surface 59 thereof.

From the foregoing, it is apparent that the receptacle 10 can receive either plug 11 as illustrated in FIG. 3 or the plug 11' as illustrated in FIG. 6. The two structures are substantially identical except for the configuration of the male connector portions extending from the surfaces 38 and 58, respectively, and it is of course apparent that other types of connecting portions can be utilized.

While only certain embodiments of the invention have been illustrated and described, it is apparent that alterations, changes, and modifications can be made without departing from the true scope and spirit thereof.

What is claimed is:

1. An electrical connector for applying energy to an electrical device comprising a receptacle and cooperating adaptor plug, said receptacle including a body of insulating material, a pair of spaced openings in one surface of said body, electrical connecting means disposed within said openings and an electric cable connected within said body to said electrical connecting means and extending from said body for connection to a power source and said adaptor plug including a body of material, a pair of pins extending from one surface of the last said body for mating with the electrical connecting means in said receptacle, a cylindrical dual contactor plug extending from another surface of said body and means within the last said body connecting each of said pins to one of the contactors of the last said plug, the surfaces of the body of said adapter plug being disposed at about 90° one relative to the other and said cylindrical dual contactor plug comprising an outer sleeve forming one contactor, a centrally disposed rod insulated from said sleeve and carrying the other contactor, the inner end of said sleeve having a lug portion extending at 90° thereto and a tubular insulating member having a diameter at least equal to the diameter of said sleeve and a section of reduced diameter disposed within said sleeve, a second lug having a circular portion overlying the outer end of said insulator and a portion extending therefrom, said rod extending through said insulator and second lug and swaged to secure it in position and said pins being coplanar with and electrically coupled to said extending lug portions.

2. An electrical connector according to claim 1 wherein said other contactor comprises a tip extending from the outer end of said sleeve and insulated therefrom.

3. An electrical connector according to claim 1 wherein said other contactor comprises a tubular member disposed within said sleeve and insulated therefrom.

* * * * *